US005556486A

United States Patent [19]

Abiven et al.

[11] Patent Number: 5,556,486

[45] Date of Patent: Sep. 17, 1996

[54] COMPOSITE MATERIAL HAVING AN INTERMETALLIC MATRIX OF ALNI REINFORCED BY SILICON CARBIDE PARTICLES

[75] Inventors: Henri Abiven, Oinville-sur-Montcient; Christophe Colin, Mantes La Jolie; Jean Bouix, Lyons; Michel Macari, St Laurent de Mure; Jean-Claude Viala, Villeurbanne, all of France

[73] Assignee: Aerospatiale SOciete Nationale Industrielle, France

[21] Appl. No.: 273,648

[22] Filed: Jul. 12, 1994

[30] Foreign Application Priority Data

Jul. 12, 1993 [FR] France ..... 93 08557

[51] Int. Cl.$^6$ ..... C22C 19/03; C22C 30/00

[52] U.S. Cl. ..... 148/429; 148/442

[58] Field of Search ..... 148/415, 437, 148/409, 429, 442

[56] References Cited

U.S. PATENT DOCUMENTS

| | | | |
|---|---|---|---|
| 4,906,531 | 3/1990 | Ohmura et al. | 148/415 |
| 4,915,903 | 4/1990 | Brupbacher et al. | 148/415 |

OTHER PUBLICATIONS

Journal of Materials Science Letters, vol. 9, No. 5, May 1990 pp. 503–505, Rawers, J. C. et al "Melt Infiltration of Selected Intermetallics Into Silicon".

Database WIP, Section Ch, Week 8517, Derwent Publications Class M26, An 85–103298 & JP–A–60 050 138 Showa Denko Mar. 1985.

Chemical Abstracts, vol. 115, No. 16, Oct. 1991, Abstract No. 164273k, Chou, T. C. et al "The Formation of NiAl phase . . . Reactions", 1045–1050, 1991.

*Primary Examiner*—Melvyn Andrews

*Attorney, Agent, or Firm*—Hayes, Soloway, Hennessey, Grossman & Hage, P.C.

[57] ABSTRACT

The invention relates to a composite material comprising a matrix mainly constituted by an intermetallic compound of the AlNi type containing in solid solution 1.5 to 30 atom % silicon and a reinforcement formed from silicon carbide (SiC) particles dispersed in said matrix.

In said material, the presence of silicon leads to a thermodynamic equilibrium system no longer evolving by SiC reinforcement/matrix chemical reaction when raised to a high temperature.

This material can be prepared by conventional processes by adding the silicon to the starting material or by carrying out a limited reaction during the preparation between an AlNi matrix and the silicon carbide particles.

18 Claims, No Drawings

COMPOSITE MATERIAL HAVING AN INTERMETALLIC MATRIX OF ALNI REINFORCED BY SILICON CARBIDE PARTICLES

The present invention relates to a composite material comprising sing an intermetallic compound matrix of the AlNi type reinforced by silicon carbide (SIC) particles and which is intended for average and high temperature applications, e.g. 600° to 1200° C., possibly in an oxidizing atmosphere.

Materials based on intermetallic compounds such as AlNi are at present subject to considerable research activity and are being developed in all the industrialized countries. In the fields of aeronautics and aerospace, where there is a considerable demand for materials having specific mechanical properties, a creep resistance and an oxidation behaviour better than those of the presently used metallic alloys, said intermetallic compounds are of great interest.

Thus, AlNi-type nickel aluminide intermetallic compounds have a low density (5.9) compared with that (9) of nickel-based superalloys and have an excellent resistant to oxidation at high temperatures. They have already been used as a protective coating, particularly on nickel-based superalloys. However, hitherto, they have not been directly usable as hot structural elements because their hot mechanical properties are very mediocre. In addition, at low temperatures, they lack ductility and have a limited toughness.

Research has also been undertaken to improve the properties of these intermetallic compounds and it has thus been envisaged to use them in the form of composite materials reinforced by fibres or particles. Composite materials of this type reinforced by tungsten fibres, alumina fibres, $TiB_2$ particles or aluminium nitride particles are described by K. Vedula in Intermetallic Compounds: Structure and Mechanical Properties, Proc. 6th, Jap Inst. of Metal Int. Symp. Sendai Japan, June 1991, pp 901–925 and by R. J. Arsenault in Advanced Structural Inorganic Composites, P. Vincenzini (Editor), Elsevier Science Publishers B.V., 1991.

However, materials reinforced with $TiB_2$ or A1203 having a much better hot creep resistance, have a less satisfactory oxidation resistance than that of the intermetallic compound AlNi. In the case of the $TiB_2$ reinforcement, this oxidation resistance reduction is due to the presence of $TiB_2$ particles, which oxidize quicker than the intermetallic compound AlNi. In the case of the $Al_2O_3$ reinforcement, this oxidation resistance reduction is due to the fact that oxygen can migrate within the composite material through microcracks existing at the $Al_2O_3$ particle-matrix interface due to the weak interfacial connection or bond.

In addition, in order to increase the hot creep resistance of an AlNi-type intermetallic compound without deteriorating its excellent natural oxidation behaviour, it is of interest to reinforce it with particles or fibres which are only slightly oxidizable, which also form with the matrix a very strong interfacial bond. Such a bond could be obtained with a reinforcement chemically reactive with respect to the matrix, but in the latter case the chemical interaction between the matrix and the reinforcement can continue throughout the time when the material is used at high temperature, which will lead to a regular reduction of its properties until the reinforcement is completely reduced.

Therefore, up to now the use of chemically reactive reinforcements with an AlNi matrix has been excluded, as indicated by Vedula, who points out on p 920 of the aforementioned document that at present there is no reinforcing fibre having all the necessary properties for a NiA1 matrix.

The present invention relates to the use as a reinforcement in an AlNi-type intermetallic matrix of a compound, silicon carbide, which although being reactive with the matrix, can be stabilized therein by supplying silicon and leads to a satisfactory composite material.

According to the invention, the composite material comprises a matrix mainly constituted by an AlNi-type intermetallic compound containing in solid solution 1.5 to 30 atom % silicon and a reinforcement formed from silicon carbide (SIC) particles dispersed in said matrix.

Thus, it has been found that the decomposition of the silicon carbide by chemical reaction with the intermetallic compound AlNi did not take place when an adequate silicon quantity was present in solid solution in the intermetallic compound AlNi.

The decomposition of the silicon carbide occurs as from approximately 700° C. by chemical reaction with the intermetallic compound AlNi, which releases aluminium carbide $Al_4C_3$ or carbon, whereas the silicon passes into solid solution form in the intermetallic compound.

However, it has surprisingly been found that this silicon carbide decomposition was completely stopped as soon as an adequate silicon quantity was dissolved in the intermetallic compound AlNi matrix. Generally, this silicon quantity is 2 to 11 atom % for materials having to withstand temperatures of 1000° C.

Therefore a material combining silicon carbide particles and an intermetallic matrix of the AlNi type containing in solid solution an adequate silicon quantity, constitutes a system in thermodynamic equilibrium which no longer evolves, by SiC reinforcement/matrix chemical reaction, when raised to a high temperature. Moreover, a limited chemical reaction between the matrix and the silicon carbide reinforcement makes it possible to create a strong interfacial connection or bond between the reinforcement and the matrix, which is advantageous for obtaining a high oxidation resistance on the part of the material.

Finally, in view of the fact that silicon carbide has good mechanical characteristics and a very good resistance to oxidation up to about 1400° C., the composite material containing a silicon carbide reinforcement has both the chemical stability and the good creep behaviour when hot of AlNi/$TiB_2$ composites, whilst still retaining the excellent oxidation resistance of non-reinforced, AlNi-type intermetallic compounds.

According to the invention, the silicon carbide particles serving as a reinforcement in the composite material can be in different forms. For example, they can be grains having an angular contour, monocrystalline platelets or flakes and/or trichites or whiskers. In addition, the silicon carbide can be in different crystalline forms, e.g. in forms corresponding to alpha-hexagonal and/or beta-cubic types.

Preferably, the silicon carbide particles have an average length, in accordance with their largest dimension, of 1 to 100 μm, because with such dimensions there is an optimum efficiency on the part of the particles when used as a reinforcement.

The composite material according to the invention can incorporate varying quantities of the particulate reinforcement. As in any composite material having a particulate reinforcement, it is of interest for increasing the ultimate strength, modulus of elasticity and creep resistance at high temperatures, to use a large amount of reinforcing particles, all the more so when the density of the silicon carbide is below that of the matrix (3.2 and 5.9 respectively), the material being lighter as the particle quantity increases. However, when the reinforcement proportion becomes high, the particles tend to come into contact with one another and form porous aggregates, which constitute weak points as from which cracks can form and propagate. Thus, there is a threshold which must not be exceeded.

Nevertheless, when it is wished to obtain a very high hot creep resistance with high SiC particle contents, it is of interest for all the SiC particles to be in direct contact, which makes it necessary to produce the material at a sufficiently high temperature to permit the welding-diffusion of the particles with respect to one another, but leads to a behaviour of the material of a fragile type.

Generally, the composite material contains 10 t 60 volume % SiC particles. The SiC particle content is also chosen as a function of the geometrical characteristics (average size, shape, etc.) of the SiC particles and grains of the matrix in order to obtain the best result. When the SiC particles have an average length, in accordance with the largest dimension thereof, of 5 to 50 μm, preference is given to the use of 10 to 30 volume % of SiC particles for obtaining a good compromise between toughness, ultimate strength and high temperature creep resistance.

The AlNi-type intermetallic compound used as the matrix in the composite material according to the invention is an intermetallic compound of aluminjure and nickel largely constituted by a phase having the structure B2 (type CsCl) characteristic of the AlNi compound and containing in solution an appropriate silicon quantity. The matrix can also include standard impurities such as alumina and/or iron in small proportions, e.g. 0.5 to 2 volume % for alumina and 0. to 2% by weight for iron, in the dissolved state or in the form of micro-prepicipates. The phase having the B2 structure of the AlNi compound is characterized by a relatively wide existence range in the AlNi binary system, because said range e.g. extends between 43 to 63 atom % nickel at 1000° C. This phase can dissolve, in solid solution form, a silicon quantity dependent on the temperature and the atomic ratio between the aluminium and the nickel.

According to the invention, any ternary alloy Al-Ni-Si of composition within the existence range of said B2 structure phase can be used as the matrix, provided that said alloy contains the minimum silicon content necessary to ensure that the intermetallic compound is in thermodynamic equilibrium with the silicon carbide at the desired temperature and therefore so that the matrix-reinforcement interface undergoes no further evolution by chemical reaction at high temperature.

This minimum content is dependent on the nickel content of the matrix and the temperature. Thus, it is 1.5% in the case of a matrix containing 43 atom % nickel at 1000° C.

Preferably, according to the invention, the intermetallic compound AlNi constituting the matrix comprises 50 to 63 atom % nickel in order to ensure that, in the case of a limited reaction between the matrix and,the silicon carbide, there is an aluminium carbide deposit at the matrix-silicon particle interface.

The composite material according to the invention can be prepared by conventional powder metallurgy or foundry processes. In view of the fact that the reinforcement and the matrix constituting the composite material are very refractory compounds, because the melting points of the silicon carbide SiC and nickel aluminide AlNi are respectively approximately 2550° and 1650° C., said processes will preferably be conventional powder metallurgy solid phase processes such as uniaxial or isostatic hot compression, or hot extrusion of mixtures of SiC and AlNi powders. However, it is also possible to prepare materials by very high temperature (above 1700° C.) foundry methods and spray by*means of a plasma or a mixed process combining high temperature foundry procedures and powder metallurgy procedures, such as the XD process of Martin Marietta.

Conversely, preparation processes using reactive sintering from aluminium and nickel powders are excluded, because the deterioration of the reinforcing particles by chemical reaction with these elements during sintering would be excessive.

Whatever the process used, it is important to choose conditions making it possible to obtain a material having the minimum porosity, in which the matrix crystals or grains are intimately welded with a uniform dispersion of SiC particles in the intermetallic matrix.

According to the invention, the silicon which must be included in the intermetallic compound matrix can be at least partly added prior to the production of the composite material, or can be obtained solely by partial decomposition of the silicon carbide particles during the production of the composite material.

In both cases, it is possible to prepare the composite material according to the invention by subjecting to a solid phase hot densification a mixture of a powder of a AlNi intermetallic compound which may or may not contain silicon and SiC particles.

It is also possible to prepare the composite material according to the invention by dispersing SiC particles in an AlNi matrix, which may or may not contain silicon, at a temperature such that the matrix is in the liquid state and the SiC particles remain in the solid state.

According to a first preparation procedure for the composite material according to the invention, they are prepared from an AlNi intermetallic compound to which silicon has been added.

In this case, the silicon quantity added can be below, equal to or above the necessary silicon content for reaching thermodynamic equilibrium between the matrix and the SiC particles.

When this quantity is equal to or exceeds the content corresponding to the matrix/particle thermodynamic equilibrium at the preparation temperature, a material is obtained which is characterized by a weak bond at the matrix/particle interface, because the chemical compatibility between the matrix and the Sic particles is ensured at all stages of the preparation of the material, so that there is no reaction between the matrix and the SiC particles.

However, when the silicon quantity added to the AlNi intermetallic compound is below that corresponding to the matrix/particle thermodynamic equilibrium at the preparation temperature of the material, there is a supplementary dissolving of the silicon in the matrix (Al—Ni—Si) by partial decomposition of the SiC particles at the preparation temperature, in order to attain the thermodynamic equilibrium at said temperature.

In this case, provided that use is made of a matrix containing more nickel than aluminium, it is possible to obtain at the SiC particle/matrix interface, a two-phase transition zone constituted by a free carbon dispersion in the matrix.

Thus, the decomposition reaction of the SiC gives silicon which diffuses very rapidly in the intermetallic compound, whereas the carbon remains in the vicinity of the particle/matrix interface in the form of submicron precipitates. These precipitates form with the matrix a particularly favourable, two-phase interfacial transition zone establishing a strong interfacial bond between the particles and the matrix.

Thus, this interfacial zone has a mean expansion coefficient intermediate between that of the particles (4 to $5.10^{-6}K^{-1}$) and that of the matrix (13 to $15.10^{-6}K^{-1}$) and therefore can gradually absorb part of the static mechanical stresses produced in thermal cycling, the carbon submicron precipitates acting as dislocation traps.

Thus, the SiC decomposition reaction is not accompanied, as in most solid-solid reactions, by the formation of a continuous layer of a fragile compound at the interface, which is particularly favourable for obtaining good mechanical properties with respect to the composite material. However, on using in said AlNi intermetallic compound, an aluminium quantity exceeding the nickel quantity, aluminium carbide ($Al_4C_3$) would form at the matrix/particle interface, which is unfavourable for the composite material, due on the one hand to the limited stability of the carbide in a wet atmosphere, and on the other due to the weaker resistance to cracking of nickel-depleted matrixes.

According to a second preparation method for the composite materials according to the invention, they are prepared from an AlNi intermetallic compound without any addition of silicon. In this case, the necessary silicon content comes solely from the decomposition reaction of the silicon carbide during the preparation of the composite material.

As hereinbefore, the aim is to use an intermetallic compound incorporating at least 50 atom % nickel in order to create around the SiC particles a two-phase transition zone constituted by a free carbon dispersion in the matrix.

In this case, the silicon quantity dissolved in the intermetallic compound matrix is dependent on the composition of the starting intermetallic compound and the preparation temperature, because it corresponds to the thermodynamic equilibrium between the matrix and the SiC particles at said temperature.

Thus, at 1000° C., said silicon quantity is 2.5 atom % when the AlNi compound contains 50 atom % Ni, 7 atom % when the AlNi compound contains 53 atom % Ni, and 11 atom % when the AlNi compound contains 56 atom % Ni.

Thus, according to the invention, by acting on the Ni/Al ratio, on the silicon quantity possibly added prior to the preparation and on the volume fraction of the SiC particles, it is possible to modify at random the degree of interaction between the matrix and the particles and as a consequence the interfacial bonding force in the resulting material.

In addition, by choosing a high silicon content and/or a preparation temperature above the temperature of use of the composite material, a material is obtained which will retain its mechanical properties during its ageing in service at high temperature because, once the preparation stage has been ended and the matrix is saturated with silicon, the assembly formed by the matrix, the SiC particles and the interfacial transition zone forms a system in thermodynamic equilibrium.

The SiC particles used for the preparation of the composite materials according to the invention can be grains with an angular contour obtained by grinding or crushing silicon carbide blocks produced industrially and constituted by crystals of the alpha-hexagonal type (more precisely a mixture of polytypes derived therefrom), quasi-monocrystalline platelets of alpha-hexagonal of beta-cubic types, obtained by appropriate crystalline growth methods, or whiskers of silicon carbide obtained by conventional processes.

The AlNi intermetallic compound containing silicon or not and used as the starting products for said preparation is also obtained by conventional processes such as reactive sintering, "O-spray" foundry or plasma spraying. It is generally used in the form of a powder having a grain size of 5 to 50 μm.

When using solid phase, hot densification methods for producing the material, said densification is brought about by using equipment and temperature and pressure conditions as are conventionally employed for producing materials of this type. The same applies when producing the material by foundry methods or spraying by means of a plasma, or the mixed XD Martin Marietta process.

Other features and advantages of the invention will become more apparent from studying the following illustrative, non-limitative examples.

EXAMPLE 1

This example uses the second method for the preparation of composite materials according to the invention starting with silicon carbide particles having an average size of 5 to 45 μm, and an AlNi single-phase, intermetallic compound having a grain size of 5 to 50 μm and a composition of 50 atom % A1 and 50 atom % Ni.

Preparation takes place of a mixture of powders containing 20 volume % of silicon carbide particles by mechanical grinding in a tungsten carbide ball mortar. The thus obtained mixture then undergoes densification by hot compression in a vacuum of 10 Pa in a cell constituted by a cylindrical die and two graphite pistons. After applying a pressure of 100 MPa for 2 h and at 1150° C., a composite material disk having a total porosity below 1% is obtained.

Metallographic examination of this disk shows that the hot compression has permitted welding by diffusion in solid phase of the intermetallic compound grains. The silicon carbide particles are uniformly dispersed in the intermetallic compound matrix and a two-phase zone containing submicron carbon precipitates is observed around each silicon carbide particle. The thickness of said two-phase zone is approximately 1.2 μm, which corresponds to decomposition by chemical reaction of approximately 14% of the initially introduced carbide. In addition, there is silicon uniformly distributed in solid solution in the matrix.

The atom % composition of said matrix is 47.7 Al, 47.9 Ni and 4.4 Si.

With this matrix composition, the silicon carbide particles can no longer react with the matrix when the temperature remains below 1150° C., which corresponds to the upper limit of use of the material. Thus, following a transient reaction making it possible to establish a strong interfacial bond between the matrix and the particles, a composite disk has been obtained in which the interface has become chemically stable.

EXAMPLE 2

In this example use is made of the first method for the preparation of composite materials according to the invention starting with a silicon carbide powder identical to that used in example 1 and an AlNi intermetallic compound powder containing silicon in solid solution and having a composition of 40 atom % Al, 53 atom % N and 7 atom % Si.

A mixture of two powders is prepared containing 30 volume % SiC particles and from said mixture is formed a composite disk by hot compression under the same conditions as in example 1.

This gives a disk having a residual porosity below 2%. In this case, the thickness of the matrix/carbon two-phase zone surrounding each silicon carbide particle is approximately 0.7 μm, which corresponds to the decomposition by chemical reaction of approximately 8% of the initially introduced silicon carbide. During this reaction, the intermetallic matrix is enriched in silicon and its final composition is 38.5 atom % Al 50.5 atom % Ni and 11 atom % Si. This material is chemically inert at 1150° C.

EXAMPLE 3

This example uses the second preparation method for the composite materials according to the invention starting with silicon carbide particles having a mean diameter of 1 to 2 μm and an AlNi compound powder (50 atom % Al and 50 atom % Ni) having an average grain size of 1 to 2 μm.

From the powder and particles is prepared a mixture containing 50 volume % SiC particles. After prolonged mechanical mixing of the mixture in the presence of liquid ethyl alcohol, the mixture is suction filtered and introduced into the graphite piston-equipped compression cell used in example 1. After drying by vacuum evaporation at ambient temperature, the mixture is progressively raised to a temperature of 1450° C. under a pressure of 100 MPa and it is maintained at this temperature and pressure for 30 min. In order to avoid an excessive detitration by aluminium evaporation, compression takes place under an argon atmosphere.

This gives a composite disk having a residual porosity below 3% and a density of approximately 4.6. Approximately 8% of the initially introduced silicon carbide were decomposed by reaction with the matrix during preparation. The matrix/carbon two-phase zone surrounding each silicon carbide particle has a thickness between 0 and 0.3 μm and the final composition of the matrix is 41 atom % Al 50 atom % Ni and 9 atom % Si.

Despite the argon atmosphere there is an aluminium loss.

EXAMPLE 4

This example uses the first method of preparing the composite materials according to the invention starting with SiC whiskers and an AlNi intermetallic compound powder containing silicon in solution having a grain size of 2 to 5 μm and a composition of 48 atom % Al 48 atom % Ni and 4 atom % Si.

The silicon carbide whiskers are of the beta-cubic variety and their extreme dimension is 0.2 to 5 μm. The whiskers are mixed with the intermetallic compound powder so as to obtain a 15 volume % whisker fraction. After mechanical mixing in the presence of a pasty organic binder, the mixture is extruded cold in ribbon form and then a disk is cut from said ribbon and is introduced into the graphite compression cell. This is followed by slow heating under a preliminary vacuum until there is a complete evaporation of the organic binder and then the mixture is raised to 1150° C. for 2 h, under a pressure of 100 MPa.

This gives a composite disk with a residual porosity below 1.5% in which the silicon carbide whiskers are preferably aligned parallel to the extrusion direction.

No chemical reaction occurred during the hot compression at the matrix/whisker interface, because the silicon quantity initially present in the intermetallic compound powder was adequate to ensure the chemical inertia of the reinforcement/matrix system up to 1150° C.

EXAMPLE 5

This example uses the second production procedure for the composite materials according to the invention starting with silicon carbide particles and an AlNi intermetallic compound powder (50 atom % Al and 50 atom % Ni) with a grain size of 5 to 10 μm. The silicon carbide particles also have an average size of 5 to 10 μm and from said particles is prepared a mixture of 15 volume % particles. After homogenization of the mixture, the latter is injected into the flame of an arc plasma torch, whose power has been regulated in such way that the intermetallic compound grains are melted, but not the SiC particles.

By spraying onto the surface of a cast iron part, a coating is obtained which adheres well, has an average thickness of 150 μm, a high hardness, an excellent resistance to abrasion and which protects the underlying part against oxidation.

The final composition of the matrix is 41 atom % Al 50 atom Ni and 9 atom % Si.

We claim:

1. Composite material comprising a matrix mainly constituted by an intermetallic compound of Al and Ni comprising 43 to 63 atom % nickel, and containing in solid solution 1.5 to 30 atom % silicon and a reinforcement formed from silicon carbide (SIC) particles dispersed in said matrix.

2. Composite material according to claim 1, characterized in that the SiC particles are in the form of grains, monocrystalline platelets and/or whiskers.

3. Composite material according to claim 1, characterized in that the silicon carbide is in a crystalline form corresponding to the alpha-hexagonal and/or beta-cubic structure.

4. Composite material according to claim 1, characterized in that the SiC particles have an average size, in accordance with their largest dimension, of 1 to 100 μm.

5. Composite material according to claim 1, characterized by comprising 10 to 60 volume % SiC particles.

6. Composite material according to claim 5, characterized in that the average size of the SiC particles is 5 to 50 μm and in that the composite material comprises 10 to 30 volume % SiC particles.

7. Composite material according to claim 1, characterized in that the intermetallic compound constituting the matrix comprises 50 to 63 atom % nickel, and is largely constituted by a phase having the B2 structure.

8. Composite material according to claim 1, characterized in that the SiC particles are surrounded by two-phase transition zone adjacent the surface of the SiC particles, consitiuted by a free carbon dispersion in the matrix.

9. Composite material according to claim 1, characterized in that the matrix also comprises 0.5 to 2 volume % alumina and/or iron in the dissolved state or in the form of microprecipitates.

10. Composite material according to claim 1, characterized in that the intermetallic compound contains 2 to 11 atom % silicon.

11. Composite material according to claim 2, characterized in that the intermetallic compound contains 2 to 11 atom % silicon.

12. Composite material according to claim 3, characterized in that the intermetallic compound contains 2 to 11 atom % silicon.

13. Composite material according to claim 4, characterized in that the intermetallic compound contains 2 to 11 atom % silicon.

14. Composite material according to claim 5, characterized in that the intermetallic compound contains 2 to 11 atom % silicon.

15. Composite material according to claim 6, characterized in that the intermetallic compound contains 2 to 11 atom % silicon.

16. Composite material according to claim 7, characterized in that the intermetallic compound contains 2 to 11 atom % silicon.

17. Composite material according to claim 8, characterized in that the intermetallic compound contains 2 to 11 atom % silicon.

18. Composite material according to claim 9, characterized in that the intermetallic compound contains 2 to 11 atom % silicon.

* * * * *

UNITED STATES PATENT AND TRADEMARK OFFICE

CERTIFICATE OF CORRECTION

PATENT NO. : 5,556,486

DATED : September 17, 1996

INVENTOR(S) : Henri Abiven, Christophe Colin, Jean Bouix, Michel Macari, and Jean-Claude Viala It is certified that error appears in the above-indentified patent and that said Letters Patent is hereby corrected as shown below:

Claim 1, Col. 8, Line 20, "(SIC)" should be --(SiC)--.

Signed and Sealed this

Eleventh Day of February, 1997

*Attest:*

Bruce Lehman

BRUCE LEHMAN

*Attesting Officer*

*Commissioner of Patents and Trademarks*